United States Patent [19]

Erickson et al.

[11] 4,250,366

[45] Feb. 10, 1981

[54] TRIGGER ASSEMBLY FOR ARC WELDING GUN

[75] Inventors: Milton W. Erickson, Crete; Donald M. White, III, Hazel Crest, both of Ill.

[73] Assignee: Dover Corporation, New York, N.Y.

[21] Appl. No.: 25,570

[22] Filed: Mar. 30, 1979

[51] Int. Cl.[3] ..... H01H 9/06

[52] U.S. Cl. ..... 200/157; 200/325

[58] Field of Search ..... 200/157, 318, 321, 323, 200/153 T, 324, 325, 61.85

[56] References Cited

U.S. PATENT DOCUMENTS

| | | | |
|---|---|---|---|
| 2,211,603 | 8/1940 | Lang | 200/157 |
| 2,586,722 | 2/1952 | Rutherford | 200/61.85 |
| 2,701,287 | 2/1955 | Winter | 200/157 |
| 2,812,418 | 11/1957 | Allan et al. | 200/157 |
| 3,469,070 | 9/1969 | Bernard et al. | 200/157 |

OTHER PUBLICATIONS

OSU Schutzgas-Schweisspistolen, EMSG literature

Binzel America Ltd. A41K MIG Welding Guns, 1978, 1976, literature and parts catalogue.

Tweco Model No. 1, Catalogue No. MG 100-78, Apr. 1978.

Tweco 400 Ampere, MIG-GUN catalog No. MG 400-76, Dec. 1976.

Tweco, MIG-GUN "Installation and Operating Instructions" for Models No. 4-AN, No. 5, No. 6, Tweco form No. MGM-12R.

*Primary Examiner*—John W. Shepperd

*Attorney, Agent, or Firm*—Hume, Clement, Brinks, Willian & Olds

[57] ABSTRACT

An improved modular trigger assembly for an arc welding gun includes a trigger housing pivotably mounted to a welding gun. A switch is mounted inside the trigger housing and is actuated by movement of the trigger housing. The trigger housing also includes a slideable locking crescent having a first end near a finger surface of the trigger housing. This locking crescent is so arranged that pressure on the first end surface serves both to depress the trigger and to lock the trigger in the depressed position.

19 Claims, 5 Drawing Figures

50
52
54
20

10
12
14
16
20
24
30
50
52
54
56
58
60
62
64
70
72
140
142
144
146
148
1a.
1a.

TRIGGER ASSEMBLY FOR ARC WELDING GUN

BACKGROUND OF THE INVENTION

This invention relates to an improved arc welding gun and particularly to an improved trigger assembly for such welding guns.

The various features of this invention are well suited for arc welding guns employing continuous feed, consumable electrodes. Although originally developed for welding guns which use a shielding gas from a separate source, the improvements of this invention are equally valuable when used in other types of welding guns, such as guns used in welding operations in which the electrode conveys material to the welding arc which generates a shielding medium at the arc or in submerged arc welding operations.

SUMMARY OF THE INVENTION

The present invention is directed to an improved trigger assembly for use in arc welding guns. According to this invention, an arc welding gun is provided with a modular trigger assembly which is pivotably mounted on the gun. A switch is mounted inside the trigger such that the trigger and the switch can be replaced as a unit. Because welding gun operators are usually gloved, a large trigger is generally required. By placing the switch inside the trigger, the volume of the trigger is utilized to reduce the volume of components which extend into the handle of the welding gun.

Preferably, the trigger assembly also includes a leaf spring which bears against the gun to bias the trigger away from the gun and also bears on and actuates the switch when the trigger is depressed. The preferred embodiment of the trigger assembly also includes a locking member slideably mounted in the trigger. This locking member is arranged such that the trigger can simultaneously be depressed and locked in the depressed position by depressing only the locking member. This arrangement is simple to use, for an operator is not required to depress two separate elements to lock the trigger, as with some welding guns of the prior art. Instead, the single motion of pressing the locking member performs both functions. Furthermore, the locking member can be released simply by momentarily depressing the trigger after the locking member has been set. Thus, no pulling motions and no coordinated manipulation of two or more elements are needed to either set or release the trigger.

The invention, together with further objects and attendant advantages, will be best understood by reference to the following description taken in connection with the accompanying drawings.

DETAILED DESCRIPTION OF PREFERRED EMBODIMENTS

Figures 1, 1A:
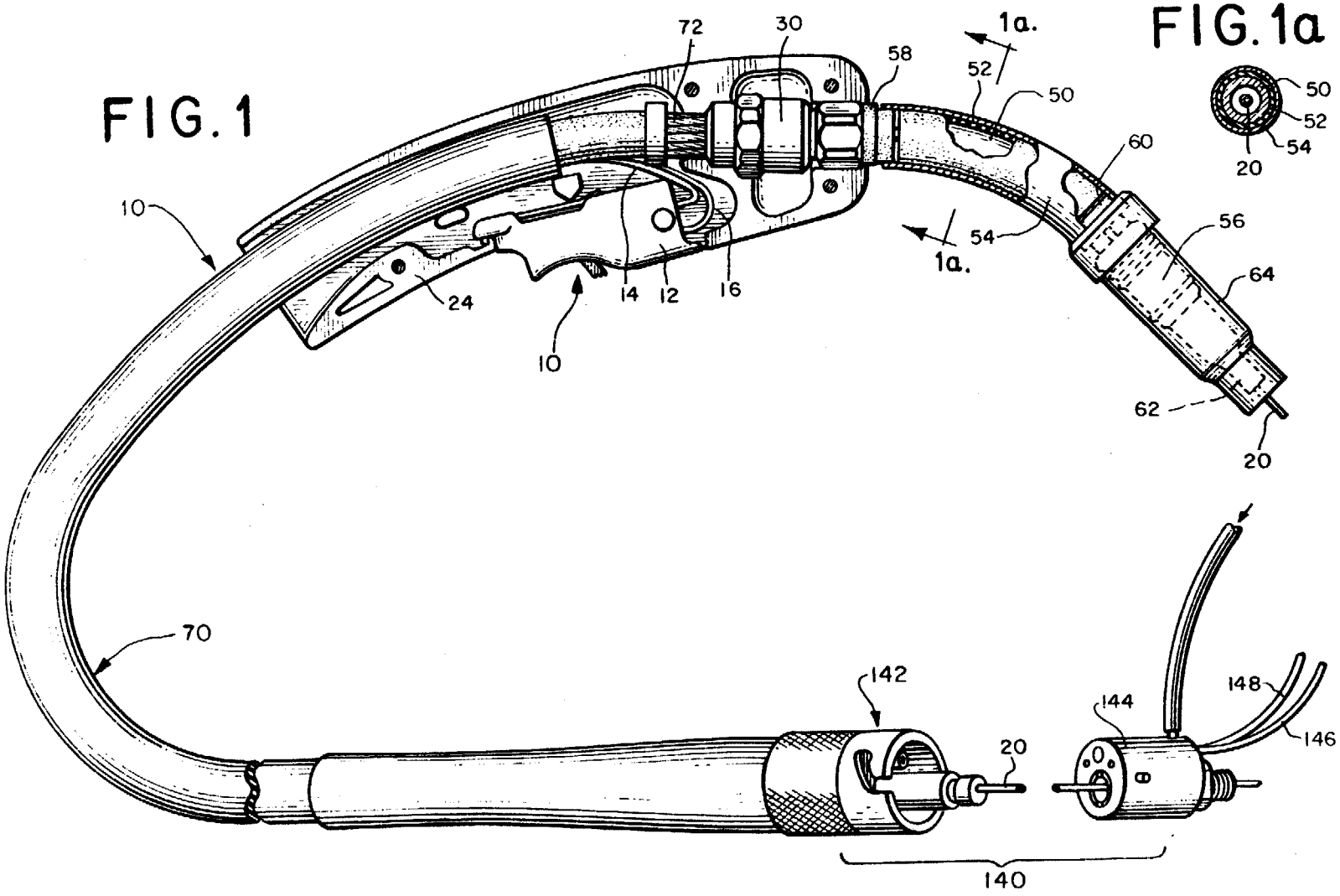
FIG. 1 is a side view in partial cutaway of an arc welding gun including a preferred embodiment of the trigger assembly of this invention.
FIG. 1*a* is a cross-sectional view taken along line 1*a*—1*a* of FIG. 1.

Referring now to the drawings, FIG. 1 represents an arc welding gun 10 which incorporates a presently preferred embodiment of the trigger assembly of this invention. This welding gun is coupled to a quick connect connector 140 by means of a cable 70. In general terms the cable 70 serves to pass continuous lengths of consumable electrode 20, shielding gas, and welding current from the quick connect connector 140 to the welding gun 10. The quick connect connector 140 comprises a connector body 142 and a connector socket 144, and in use the socket 144 is coupled to a conventional source of continuous lengths of electrode, such as a wire feeder unit (not shown) and to conventional sources of shielding gas and welding current. Also, a pair of control leads 146,148 for controlling the wire feeder unit (not shown) is coupled to the socket 144. These control leads 146,148 are connected by the connector 140 to a pair of control conductors 14,16 in the cable 70. The conductors 14,16 are switched at the switch assembly 12 by the gun operator to control feeding of the electrode 20 to the gun 10.

The welding gun 10 in FIG. 1 includes an insulating handle 24, a cable clamp 30, a gooseneck 50, and a head assembly 56, in addition to the trigger assembly 12. As shown in FIG. 1, one half of the handle 24 has been removed to show the internal components of the gun 10. In use, the handle 24 would be assembled to completely enclose the internal parts of the gun 10 to protect the operator from exposure to welding current and associated heat. Preferably, the handle 24 is formed from a rugged insulating plastic in two halves which are reversably fastened together. The cable clamp 30 serves to secure the cable 70 in the gun 10 by firmly gripping the power conductors of the cable 70. The clamp 30 is securely connected to the gooseneck 50, by means of silver solder, for example, and serves to conduct welding current from the power conductors to the gooseneck 50.

The gooseneck 50 is a curved sleeve connected at one end to the clamp 30 and at the other end to the head assembly 56. The gooseneck 50, which is insulated by a silicone sleeve 52, is surrounded by an armor sleeve 54 which is held in place by insulating rings 58,60. The head assembly 56 conducts the welding current to a replaceable contact tip 62, which is preferably a locking contact tip as disclosed in U.S. Pat. No. 3,514,570. The contact tip 62 conducts welding current to the electrode 20 in the conventional manner. A gas nozzle 64 surrounds the contact tip 62 and conducts shielding gas to the welding arc.

Thus, the welding gun 10 conducts both shielding gas and welding current from the cable 70 through the clamp 30, the gooseneck 50, and the head assembly 56 to the region of the arc.

Figure 2:
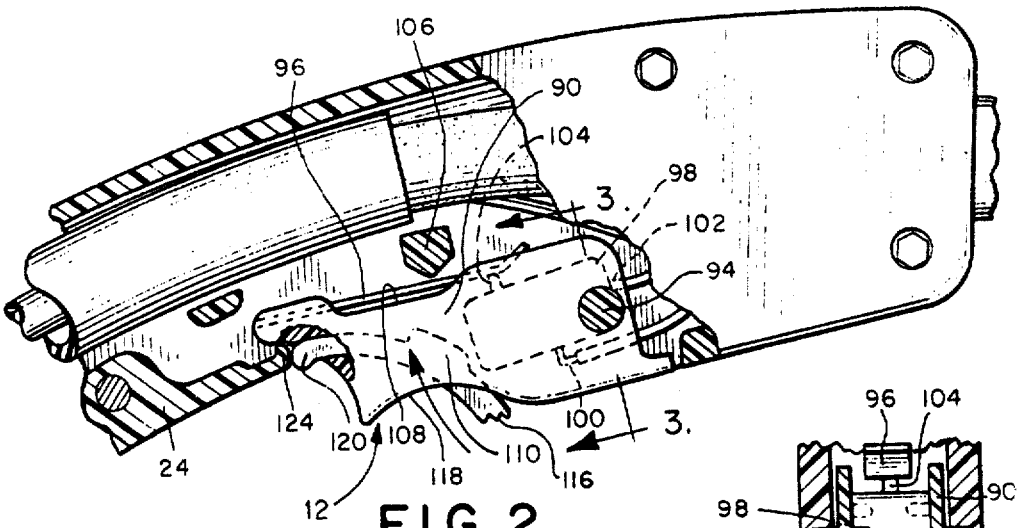
FIG. 2 is a detail view of the trigger assembly of FIG. 1.
Figure 3:
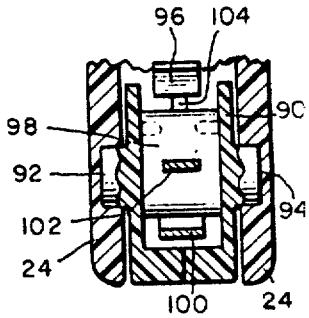
FIG. 3 is a sectional view taken along line 2—2 of FIG. 2.
Figure 4:
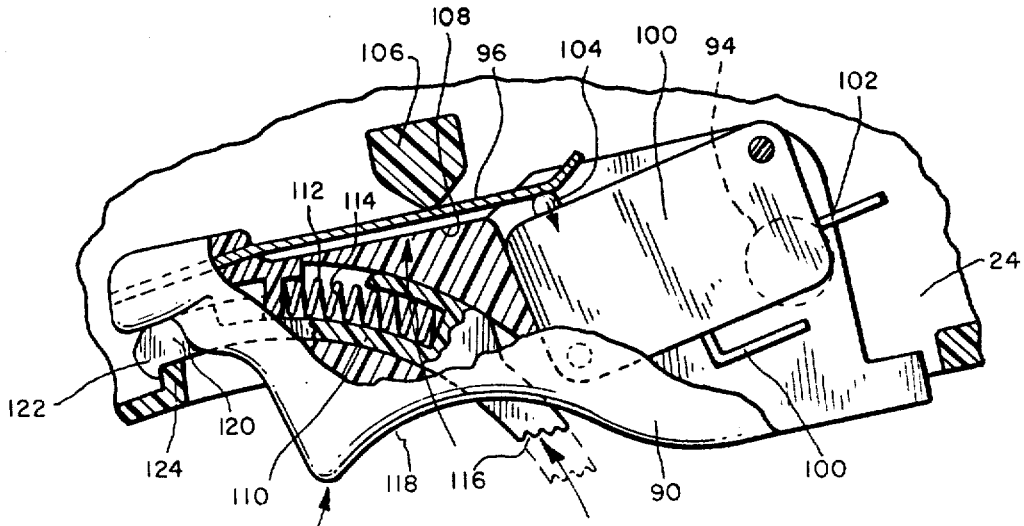
FIG. 4 is a detailed view of the trigger assembly of FIG. 2 showing the trigger locked in the down position.

The trigger assembly 12 is shown generally in FIG. 1 and in greater detail in FIGS. 2–4. The trigger assembly 12 includes a trigger housing 90 molded from a heat resistant, insulating plastic material. The housing 90 defines two trigger pivots 92,94 which are sized to fit within matching trigger sockets formed in the welding gun handle 24. The trigger pivots 92,94 pivotably mount the trigger assembly 12 to the handle 24.

Mounted in the trigger housing 90 are a leaf spring 96 and a sealed two position switch 98 having a pair of terminals 100,102 and an actuating button 104. The switch 98 operates to connect and disconnect the terminals 100,102 depending on the position of the actuating button 104. As installed in the welding gun 10, the switch terminals 100,102 are connected to the control leads 12,14, and the switch operates to control the feeding of the electrodes 20 to the gun 10.

The leaf spring 96 bears on a contact surface 106 formed in the handle 24 and simultaneously acts to bias the trigger assembly 12 away from the handle 24 and to contact the actuating button 104. One advantage of this arrangement is an economy of parts. A second advantage is that the switch 98 is protected from excessive switching forces; the housing 90 defines a surface 108 which limits the range of travel of the spring 96 to protect the switch 98 from over travel of the trigger assembly.

The elements described above provide a self-contained, modular switching assembly which is well suited for use in welding guns where momentary trigger actuation is required. Some applications, however, require a trigger which can be locked in position, and for these applications, a spring loaded locking crescent 110 is provided.

This locking crescent 110 is slideably mounted in a curved groove 112 formed in the trigger housing 90 and is spring biased by a coil spring 114 into the position shown in FIG. 2. The locking crescent 110 defines a first end section 116 adjacent the finger surface 118 of the housing 90. This end section 116 is preferably serrated to provide a slip free surface. The other end section 120 is provided with a lip 122 sized to engage a mating lip 124 formed in the housing 24.

In operation the locking crescent 110 allows an operator to either lock the trigger down or release the trigger from its locked position with a single squeeze of the trigger assembly 12. When pressure is applied to the serrated end section 116 of the locking crescent 110, the pressure pivots the trigger housing 90 and actuates the switch 98. Simultaneously, this pressure slides the locking crescent 110 from the position shown in FIG. 2 to that shown in FIG. 4, where the lip 122 on the locking crescent 110 engages the lip 124 on the handle 24 to lock the trigger housing 90 in the down position. Once the trigger housing 90 is locked down, momentary pressure on the finger surface 118 disengages the locking crescent 110 from the lip 124, and the spring 114 then returns the locking crescent 110 to the position shown in FIG. 2. This unlocks the trigger housing 90.

Thus, it can be seen that the trigger assembly 12 can be locked or unlocked by momentary pressure. The operator is not required to manipulate more than one element to lock the trigger, nor is any pulling action required. This trigger assembly 12 can be conveinently locked and unlocked by a gloved operator and it is, therefore, well suited for use in welding guns.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. A trigger assembly for an arc welding gun, said trigger assembly comprising:

a trigger housing defining a finger surface;

means for pivotably mounting the trigger housing to the welding gun such that the trigger housing is movable between a rest position and an actuated position;

a switch mounted inside the trigger housing;

means for actuating the switch in response to movement of the trigger housing from the rest position to the actuated position; and means for releasably locking the trigger housing in the actuated position, said locking means comprising a locking crescent slideably mounted in the trigger housing, said crescent having a first end section positioned adjacent the finger surface of the trigger and a second end section defining a locking surface for engaging the welding gun, said locking crescent positioned such that pressure on the first end section both pivots the trigger housing into and locks the trigger housing in the actuated position.

2. The invention of claim 1 wherein the locking means further comprises a spring positioned to bias the first end section of the locking crescent into an extended position in which the first end section protrudes out of the trigger housing adjacent the finger surface.

3. The invention of claim 2 wherein the spring is a coil spring mounted within a recess defined by the locking crescent to extend generally along the length of the crescent.

4. The invention of claim 1 wherein the second end section of the locking crescent is positioned to abut the welding gun when the trigger housing is in the rest position such that the locking crescent is prevented from sliding in the trigger housing until after the trigger housing has pivoted into the actuated position.

5. A trigger assembly for an arc welding gun including a contact element, said trigger assembly comprising:

a trigger having a finger surface;

means for pivotably mounting the trigger to the welding gun such that the trigger is pivotable between first and second positions;

a switch mounted in the trigger and including an actuating element;

a leaf spring mounted on the trigger and positioned to bear on the contact element of the welding gun to bias the trigger into the first position, said spring including a surface which bears on the actuating element when the trigger is in the second position; and means, including a locking member, for locking the trigger in the second position, said locking member slideably mounted in the trigger and having a first end section adjacent the finger surface and a second end section provided with a locking element for engaging the welding gun, said locking member positioned such that pressure on the first end section both pivots the trigger into and locks the trigger in the second position.

6. The invention of claim 5 wherein the locking member is crescent shaped.

7. The invention of claim 5 wherein the locking means further includes a locking member spring mounted between the trigger and the locking member to bias the first end section of the locking member into an extended position in which the first end section protrudes out of the trigger adjacent the finger surface.

8. The invention of claim 7 wherein the locking member spring is a coil spring mounted in a recess defined by the locking member.

9. The invention of claim 5 wherein the surface of the leaf spring which bears on the actuating element is spaced from the point at which the leaf spring bears on the contact element thereby providing protection to the switch against trigger overtravel.

10. The invention of claim 5 wherein the point on the leaf spring at which the leaf spring bears on the contact element is situated between the point where the leaf spring is mounted on the trigger and the surface of the leaf spring which bears on the actuating element, thereby providing protection to the switch against trigger overtravel.

11. A trigger assembly for an arc welding gun including a contact element, said trigger assembly comprising:

a trigger housing;

means for pivotably mounting the trigger housing to the welding gun;

a switch mounted inside the trigger housing, said switch including an actuating element;

means for actuating the switch in response to movement of the trigger housing; and a leaf spring included in the actuating means and mounted on the trigger housing, said leaf spring positioned both to bear on the contact element of the welding gun to bias the trigger housing away from the contact element and to bear against the actuating element for a predetermined range of trigger housing positions.

12. The invention of claim 11 wherein the leaf spring bears on the contact element at a first point and the leaf spring bears on the actuating element at a second point, spaced from the first point to provide overtravel protection to the switch.

13. The invention of claim 11 wherein the leaf spring bears on the contact element at a point on the spring between the point where the leaf spring bears on the actuating element and the point where the leaf spring is mounted on the trigger housing to provide overtravel protection to the switch.

14. A trigger assembly for an arc welding gun including a contact element, said trigger assembly comprising:

a trigger having a finger surface;

means for pivotably mounting the trigger to the welding gun such that the trigger is pivotable between a rest position and a depressed position;

a switch mounted in the trigger and including an actuating element having a normal position and an actuated position;

a leaf spring mounted in the trigger and positioned to bear on the contact element to bias the trigger into the rest position, said spring including an actuating surface, spaced from the point at which the spring contacts the contact element, which bears on the actuating element to move the actuating element from the normal position to the actuated position when the trigger is pivoted from the rest position to the depressed position;

a crescent shaped locking plunger mounted to slide in the trigger, said locking plunger having a first end section adjacent the finger surface and a second end section provided with a locking element for engaging the welding gun, said locking plunger movable between an extended position, in which the first end section protrudes out of the trigger adjacent the finger surface, and a locked position, in which the second end section extends out of the trigger such that the locking element engages the welding gun, said locking plunger positioned such that pressure on the first end section acts to pivot the trigger into the depressed position and then to slide the locking plunger into the locked position to lock the trigger in the depressed position; and a spring mounted in the trigger to bias the locking plunger to the extended position.

15. A trigger assembly for a hand held implement, said trigger assembly comprising:

a trigger defining a finger surface;

means for pivotably mounting the trigger to the implement;

a switch mounted in the trigger;

means for actuating the switch in response to movement of the trigger from a rest position to an actuated position; and means, including a locking member, for releasably locking the trigger in the acutated position, said locking member having a first end section positioned adjacent the finger surface and a second end section defining a locking surface for engaging the implement, said locking member mounted in the trigger to move between an extended position, in which the first end section extends out of the trigger adjacent the trigger surface; and a depressed position, in which the second end section is positioned to engage the implement, said locking member positioned such that pressure on the first end section both pivots the trigger into the actuated position and moves the locking member into the depressed position to lock the trigger in the actuated position.

16. The invention of claim 15 wherein the locking member is crescent shaped and mounted to slide in the trigger.

17. The invention of claim 15 wherein the second end of the locking member abuts the implement when the trigger is in the rest position such that the locking member is not movable to the depressed position until after the trigger has been pivoted to the actuated position.

18. The invention of claim 15 further comprising a spring mounted between the locking member and the trigger to bias the locking member to the extended position.

19. The invention of claim 18 wherein the spring is mounted in a recess defined in the locking member.

* * * * *